US005478450A

United States Patent [19]

Buck

[11] Patent Number: 5,478,450

[45] Date of Patent: Dec. 26, 1995

[54] METHOD AND APPARATUS FOR ELECTROLYTIC CLEANING

[76] Inventor: Robert M. Buck, 16606 NE. 3rd Ave., North Miami, Fla. 33162

[21] Appl. No.: 364,539

[22] Filed: Dec. 27, 1994

[51] Int. Cl.[6] ..... C25F 1/00; C25F 7/00

[52] U.S. Cl. ..... 204/141.5; 204/224 M; 204/271

[58] Field of Search ..... 204/271, 141.5, 204/224 M

[56] References Cited

U.S. PATENT DOCUMENTS

| | | | |
|---|---|---|---|
| 3,497,445 | 2/1970 | Berglund et al. | 204/141.5 X |
| 3,775,279 | 11/1973 | Boley | 204/141.5 X |
| 4,966,673 | 10/1990 | Accattato | 204/224 M |

*Primary Examiner*—Donald R. Valentine
*Attorney, Agent, or Firm*—Herbert L. Lerner; Laurence A. Greenberg

[57] ABSTRACT

Precious metal-plated objects are cleaned by immersing them into a container filled with water. The electrical conductivity of the water is increased be adding an ion spender such as sodium carbonate therein. The positive terminal of a direct voltage source is connected to a metal plate such as aluminum plate immersed in the water bath. The precious metal-plated object to be cleaned is connected to the negative pole of the direct voltage source. The direct voltage is adjusted to between 1.5 and 9 V and the object is immersed for a few seconds. A kit for performing the method may be embodied as a battery-powered unit, or it may be provided with an a.c. adapter and an adjusting potentiometer allowing user-adjusted cleaning voltage.

10 Claims, 1 Drawing Sheet

METHOD AND APPARATUS FOR ELECTROLYTIC CLEANING

BACKGROUND OF THE INVENTION

1. Field of the Invention

The invention relates to a method and an apparatus for cleaning silver or gold plated costume jewelry by an electrolytic process.

Silver, gold and copper (group IB of the periodic table) are referred to as coinage metals. They have been widely used as coinage and jewelry metals. Besides the fact that these metals often occur in the uncombined state in nature, they are quite highly unreactive. For instance, silver has an oxidation potential of $E^o$=0.7994 V ($Ag^+ + e^- \rightarrow Ag$), so that it does not readily dissolve. The prevalent oxidation state of silver is +1. Upon exposure to air, it is not attacked by oxygen. Upon exposure to hydrogen sulfide or foods which contain sulfur, however, silver tarnishes readily. Tarnish is a thin film of $Ag_2S$, which dulls the otherwise lustrous, reflective properties of silver, and which forms in the reaction, $$4Ag+2H_2S+O_2 \rightarrow 2AgS+2H_2O$$

It is often necessary, or at least desireable, to clean such surfaces. Jewelry and tableware are often plated with silver. The latter is usually plated with a layer several (hundred) microns thick, so that any type of cleaning method is suitable. Accordingly, silver-plated tableware is usually cleaned with harsh and abrasive chemicals, which remove the layer of tarnish as well as a few additional layers of pure metallic silver. Sterling silver is 92.5% silver and 7.5% copper. Silver jewelry metal contains 80% silver and 20% copper or nickel, where the latter is added to harden the alloy.

Costume jewelry, however, is plated with a very thin layer (at most 10 microns) of 0.999 silver. It is thus paramount that only the tarnish be removed, while the silver is retained on the plate.

DESCRIPTION OF THE RELATED ART

Electrolytic cleaning methods have been described heretofore in U.S. Pat. Nos. 3,457,151 to Kortejarvi, 4,443,305 to Haynes, and 5,129,999 to Holland et al., for instance. Kortejarvi teaches that hydrogen bubble scrubbing action "at the cathodic and conductive portions of the board effectively cleans all of the surfaces thereof " such that any surface surface deposits and smut remaining on the articles after electrolysis, may be removed by dipping in a solution comprising a deoxidant. The patent teaches a two-stage process which includes scrubbing with hydrogen bubbles, which clean the copper circuitry and printed circuit boards (non-conductive), or hydrogen bubbles clean when in close proximity to a non-conductive or irregular shaped surface. The objects are deoxided with the deoxidant dip for removing the copper oxide.

Tank construction considerations suggest a material such as stainless steel or Monel (2-5) due to the highly corrosive nature of the process and additional chemicals required to obtain the the high electrical conductivity necessary to effect the creation of hydrogen bubbles. Kortejarvi requires that the electrolyte bath be heated and that ammonium carbonate and ammonium hydroxide in the electrolyte are used for increasing the electrical conductivity of the solution. Immersion time is a few seconds to five minutes. In testing the Kortejarvi invention, the electrolyte solution had been heated to 180 degrees Fahrenheit. The deoxidant bath includes 9 oz. of trisodium phosphate, 1 oz. of ammonium carbonate, 1 oz. of sodium phosphate, 2 oz. of sodium hexametaphosphate, 1 oz. of sodium metasilicate, 2 ml of ammonium hydroxide, 4 gm of sodium lauryl sulfate and one gallon of distilled water, then diluted 1:1 with tap water for his electrolytic bath. Phosphates such as the type used in Kortejarvi's bath are common in harsh industrial cleaners. These chemicals are not particularly biodegradable or environmentally safe.

SUMMARY OF THE INVENTION

It is accordingly an object of the invention to provide a method and an apparatus for electrolytic cleaning, which overcomes the hereinafore-mentioned disadvantages of the heretofore-known devices of this general type and which allows the removal of tarnish ($Ag_2S$) and similar impurities from silver or gold-plated metals, without attacking or removing the silver or the gold plate itself. It is a further object of the invention to provide a cleaning process in a 100% environmentally safe manner using a non-toxic, biodegradable electrolyte. Another object is to provide a simple, quick, easy-to-use to use, on-step process consumer product that affords instantaneous results or immediate gratification. Finally, it is an object to provide a process to be used by the consumer that is safe even when used by children and young adults.

With the foregoing and other objects in view there is provided, in accordance with the invention, a method of cleaning precious metal-plated objects, which comprises:

filling a container with water and increasing an electrical conductivity of the water;

connecting a positive terminal immersed in the water to a positive pole of a direct voltage source;

connecting a precious metal-plated object to be cleaned to a negative pole of the direct voltage source, and adjusting the direct voltage source to a potential difference between the positive and negative poles to a range between 1.5 V and 9 V; and immersing the object to be cleaned in the water for a given period of time.

In accordance with an added mode of the invention, the step of increasing the electrical conductivity comprises adding an ion spender to the water, such as sodium carbonate, sodium chloride and sodium bicarbonate.

In accordance with an additional mode of the invention, the given period of time is chosen as a function of the potential difference between the positive and negative poles of the direct voltage source. The period is between one and fifteen seconds, and most preferably not more than two seconds.

In accordance with a concomitant mode of the invention, a plate of aluminum as the positive terminal is immersed into the water and the plate is connected to the positive pole of the direct current source.

With the foregoing and other objects in view, there is also provided, in accordance with a further feature of the invention, a kit for cleaning precious metal-plated objects, comprising:

a housing defining a water cavity for receiving water therein, the housing having a top opening for receiving a precious metal-plated object therethrough to be immersed into the water in the water cavity, and a battery compartment contiguous with the water cavity for receiving a battery therein;

a metal plate disposed in the water cavity and electrically connected to a positive terminal of the battery received in the battery compartment; and connecting means for electrically connecting a negative pole of the battery to a precious metal-plated object to be cleaned.

In accordance with yet a further feature of the invention, the metal plate forms a wall between the water cavity and the battery compartment.

Alternatively, the kit may be a mains-powered unit which comprises: a housing defining a water cavity for receiving water therein, the housing having a top opening for receiving a precious metal-plated object therethrough to be immersed into the water in the water cavity, and an ac/dc converter to be connected to a.c. mains and having a d.c. voltage output; a metal plate disposed in the water cavity and electrically connected to a positive terminal of the d.c. voltage output; and connecting means for electrically connecting a negative terminal of the d.c. voltage output to a precious metal-plated object to be cleaned.

In accordance with yet a further feature of the invention, the ac/dc converter is disposed in a compartment formed in the housing contiguous with the water cavity.

In accordance with yet another feature of the invention, the kit further comprises means for increasing a conductivity of the water in the water cavity.

Recognizing comparable prior art devices, the instantly disclosed invention offers a process specific to deoxidizing and detarnishing gold and silver. Silver oxide is the least soluble in water of all the silver compounds. When d.c. current is applied to the anode, the improved method of reduction for silver tarnish is instantaneous upon immersion of the item (cathode) into the electrolyte. Unlike other processes, the use of sodium carbonate in the electrolyte and the particular properties of the anode metal yield an immediate removal of the tarnish, releasing minute quantities of hydrogen sulfide gas resulting in an almost potable and biodegradable electrolyte. The compact apparatus incorporates features which are advantageous for consumer use in that the self-contained, hand-held unit operates on a 1.5 to 9-volt battery.

In our deoxidizing process, hydrogen sulfide gas bubbles are released as a by-product of the electro-chemical reaction and do not serve as a cleaning agent. Since the compound which is removed is dissolved and/or reduced through the electrolytic process, any potential smut, grease, etc. clinging or adhered to the compound is also simultaneously released into the electrolyte solution as a result of the reduction.

Other features which are considered as characteristic for the invention are set forth in the appended claims.

Although the invention is illustrated and described herein as embodied in a method and apparatus for electrolytic cleaning it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
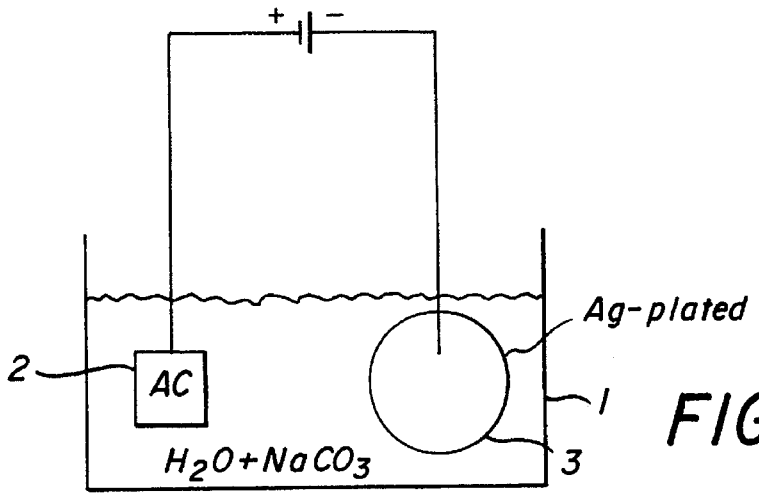
FIG. 1 is a diagrammatic elevational view of a electrolytic cleaning kit according to the invention.

Referring now to the figures of the drawing in detail and first, particularly, to FIG. 1 thereof, there is seen a container 1 filled with water. The water need not be deionized but it should be reasonably clean in terms of positively charged metal ions. The conductivity of the water is increased by adding sodium carbonate. While the amount of the added compound may be varied within a wide range, the addition of sodium carbonate in the amount of approximately 0.5 to 1.5% by weight of the water (e.g. 0.5 to 1.5 g/l water) leads to acceptable results.

An aluminum plate 2 is immersed in the water. The plate 2 is preferably formed of 3003/H14 grade aluminum. The item of jewelry to be cleaned is illustrated as a ring 3.

A source of emf, such as a battery or any dc current source, is electrically connected to the item of jewelry to be cleaned (ring 3) and to the aluminum plate 2. The aluminum plate 2 is connected to positive potential (+) and the ring 3 is connected to negative potential (–). In other words, the aluminum plate 2 acts as the anode and the ring 3 acts as the cathode. The potential difference between the two electrodes may be adjusted in the range between 1.5 V and 9 V. The lower limit of the potential appears to be defined as being twice the oxidation potential of silver.

As best understood, the bond of the $Ag_2S$ (tarnish) molecule is broken by the flow of current, wherein the sulfur atom is replaced by two electrons, and the sulfide ion $S^{2-}$ goes into solution. Further reactions involving the sulfide ion are not important in this context, but it would appear that the sulfur reacts with water to form hydrogen sulfide gas, which escapes by bubbling out of the water bath.

The foregoing method does not remove any appreciable amounts of silver from the jewelry item. This was repeatedly tested by means of standard qualitative elemental analysis, as for instance by adding hydrochloric acid (HCl), $HNO_3$, $NH_4Cl$, and watching for clouding of the solution, as well as testing the precipitate.

Figure 2:
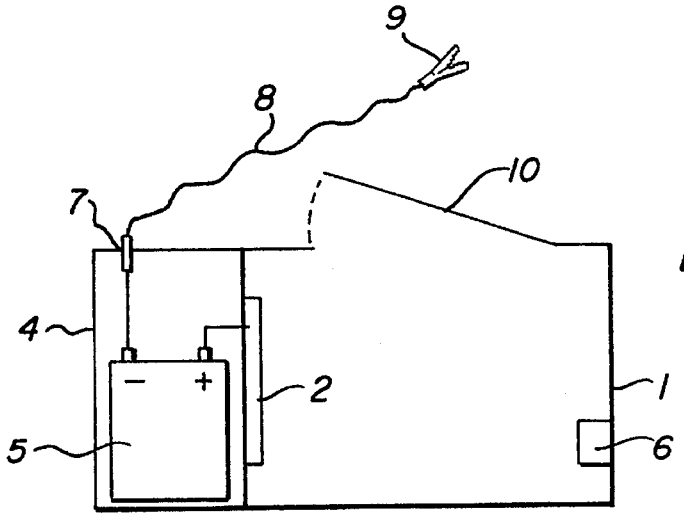
FIG. 2 is a similar view of a battery-powered cleaning kit according to the invention.

A kit for performing the electrolytic cleaning process is illustrated in FIG. 2. In this embodiment, the container 1 is provided with a side-compartment 4, contiguous therewith, which houses the source of emf, in this case a battery 5. The positive terminal of the battery is permanently wired to the aluminum plate 2. The entire wall forming the division between the water-receiving container opening and the battery housing 4 may be formed of aluminum. In an alternative embodiment, the entire housing may be formed of aluminum. An ion spender 6 is provided inside the housing, for instance in the form of a solid salt which slowly dissolves when water is placed in the housing cavity. In the alternative, the kit may include a supply of sodium carbonate and instructions to the user to add a sufficient amount prior to performing the method. The negative terminal of the battery 5 is wired to a terminal 7 at the top lid of the battery compartment 4. A wire 8 is plugged into the terminal 7 with an appropriate connector. The free end of the wire 8 is provided with an alligator clip 9, for instance, which enables the user to easily clamp the item to be cleaned. A lid 10 is provided at the top of the water-receiving cavity.

Figure 3:
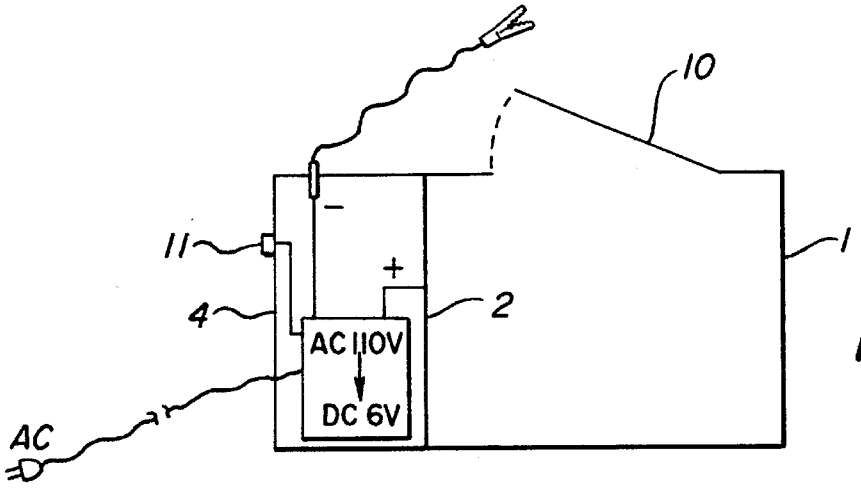
FIG. 3 is a similar view of a mains-powered embodiment of the invention.

Referring now to FIG. 3, which shows an alternative embodiment of the cleaning kit, an ac/dc converter is provided which allows the kit to be powered from a mains outlet. In addition, a user controlled power adjustment potentiometer 11 may be provided, which allows the d.c. output voltage to be varied within an acceptable range, for instance 1.5 V to 10 V.

I claim:

1. A method of cleaning precious metal-plated objects, which comprises:

filling a container with water and increasing an electrical conductivity of the water;

immersing a plate of aluminum in water, and connecting the plate of aluminum immersed in the water to a positive pole of a direct voltage source;

connecting a precious metal-plated object to be cleaned to a negative pole of the direct voltage source, and adjusting the direct voltage source to a potential difference between the positive and negative poles to a range between 1.5 V and 9 V; and immersing the object to be cleaned in the water for a given period of time.

2. The method according to claim 1, wherein the step of increasing the electrical conductivity comprises adding an ion spender to the water.

3. The method according to claim 1, which comprises adding the ion spender in the form of a sodium compound selected from the group of sodium chloride, sodium carbonate and sodium bicarbonate.

4. The method according to claim 1, which comprises choosing the given period of time as a function of the potential difference between the positive and negative poles of the direct voltage source.

5. The method according to claim 1, which comprises choosing the given period of time between one and fifteen seconds.

6. A kit for cleaning precious metal-plated objects, comprising:

a housing defining a water cavity for receiving water there-in, said housing having a top opening for receiving a precious metal-plated object therethrough to be immersed into the water in said water cavity, and a battery compartment contiguous with said water cavity for receiving a battery therein;

a metal plate disposed in said water cavity and forming a wall between said water cavity and said battery compartment, said metal plate being electrically connected to a positive terminal of the battery received in said battery compartment; and connecting means for electrically connecting a negative pole of the battery to a precious metal-plated object to be cleaned.

7. The kit according to claim 6, which further comprises means for increasing a conductivity of the water in said water cavity.

8. A kit for cleaning precious metal-plated objects, comprising:

a housing defining a water cavity for receiving water therein, said housing having a top opening for receiving a precious metal-plated object therethrough to be immersed into the water in said water cavity, and an ac/dc converter to be connected to a.c. mains and having a d.c. voltage output;

a metal plate disposed in said water cavity and forming a wall between said water cavity and said battery compartment, said metal plate being electrically connected to a positive terminal of said d.c. voltage output; and connecting means for electrically connecting a negative terminal of said d.c. voltage output to a precious metal-plated object to be cleaned.

9. The kit according to claim 8, wherein said ac/dc converter is disposed in a compartment formed in said housing contiguous with said water cavity.

10. The kit according to claim 9, which further comprises means for increasing a conductivity of the water in said water cavity.

* * * * *